US006076707A

United States Patent [19]

Feldner

[11] Patent Number: 6,076,707

[45] Date of Patent: Jun. 20, 2000

[54] BEVERAGE BOTTLE AND STORAGE AND DISPENSING RACK THEREFOR

[76] Inventor: Thomas W. Feldner, 2932 Stone Pine Rd., Orange, Calif. 92867

[21] Appl. No.: 09/161,910

[22] Filed: Sep. 28, 1998

[51] Int. Cl.[7] ..... B67D 5/06

[52] U.S. Cl. ..... 222/181.1; 211/74; 211/189; 220/630; 248/150; 248/176.1; 222/185.1; D9/455

[58] Field of Search ..... 222/181.2, 181.3, 222/185.1; 248/150, 151, 146, 176.1; 211/74, 189, 133.1; D9/455, 516, 517, 535, 569, 570; 220/629–631

[56] References Cited

U.S. PATENT DOCUMENTS

| | | | |
|---|---|---|---|
| D. 396,008 | 7/1998 | Hay | D9/455 |
| 4,143,795 | 3/1979 | Casebier | 222/185.1 X |
| 5,370,245 | 12/1994 | Tersch et al. | 248/150 X |
| 5,419,448 | 5/1995 | Watson | 222/185.1 X |
| 5,472,098 | 12/1995 | Ho | 248/150 X |

*Primary Examiner*—Henry J. Recla
*Assistant Examiner*—Kathleen J. Prunner
*Attorney, Agent, or Firm*—Robert Strauss

[57] ABSTRACT

The combination of a storage and dispensing rack and a beverage container which has a general parallelpiped shape with at least two channels traversing its opposite major walls at intermediate locations along the length of the walls. The storage and dispensing rack comprises a support base formed of a pair of longitudinal and parallel rails spaced apart approximately equal to the width of the bottle with two H-shaped cradles each having distal stiles separated by a cross rail and removably engaged to the longitudinal rails of the base to coincide with the channels in the major walls of the container whereby the container can be placed and interlocked into the rack. The cross rails of the cradles are located asymmetrical along the stiles whereby the cradles can be reversed end to end to provide a compact, low elevation position and a dispensing, high elevation position of the beverage

7 Claims, 7 Drawing Sheets

BEVERAGE BOTTLE AND STORAGE AND DISPENSING RACK THEREFOR

BACKGROUND OF THE INVENTION

1. Field of Invention

This invention relates to a storage rack and, in particular, to a rack for the storage of a beverage container and for dispensing of beverage from the container.

2. Brief Statement of the Prior Art

Large beverage containers, typically having two and one-half gallon capacities, are used commonly for drinking water. The most common and popular shaped container is a blow molded plastic container having a parallelepiped shape with a pair of wall channels at intermediate positions traversing its major wall and a central section of reduced height to accommodate an integral handle. The container has a beveled lower front edge on which is placed a dispensing valve. This construction positions the dispensing valve close to the surface on which the container is rested thereby creating difficulties when attempting to dispense the contents from the container resting on a flat shelf or countertop.

Various supports have been patented for this ubiquitous beverage container such as the bracket and hook support shown in U.S. Pat. No. 4,121,800, and the refrigerated cases disclosed in U.S. Pat. Nos. 4,757,920 and 4,913,713. Another rack for dispensing of water from these containers is shown in U.S. Pat. No. 4,341,328. Commonly the beverage containers are placed on a refrigerator shelf with the dispensing spout extending slightly over the front edge of the shelf thereby permitting dispensing water from the container while the container is in the refrigerator. Frequently, however, it is desirable to place the container on a countertop where the valve is inconvenient to access. None of the prior art racks or hangers provides an adequate solution to this problem.

OBJECTIVES OF THE INVENTION

It is an objective of this invention to provide a rack which is suitable for storage and for dispensing of the contents of a liquid beverage container.

It is likewise an objective of the invention to provide a rack which is suitable for the compact storage of a large beverage container.

It is a further objective of the invention to provide a rack which is useful for positioning a beverage container in a dispensing position on a counter top or a similar supporting surface.

It is an additional objective of this invention to provide a beverage container storage rack with a simple, knock-down construction for ease in marketing and distribution.

Other and related objectives will be apparent from the following description of the invention.

BRIEF DESCRIPTION OF THE INVENTION

The invention comprises a storage and dispensing rack for a beverage container having a general parallelpiped shape with at least two channels traversing its opposite major walls at intermediate locations along the length of the walls. The rack comprises a support base formed of a pair of longitudinal and parallel rails spaced apart approximately equal to the width of the bottle with two pair of upright standards removably supported on the rails. The standards have distal stiles supported at spaced-apart locations to coincide with the channels in the major walls of the container whereby the container can be placed and interlocked into the rack. Preferably, the rack provides alternate orientations of the beverage bottle including a compact, low elevation position and a dispensing, high elevation position.

BRIEF DESCRIPTION OF THE FIGURES

The invention will be described with reference to the Figures of which.

DESCRIPTION OF THE PREFERRED EMBODIMENT

Figure 1:
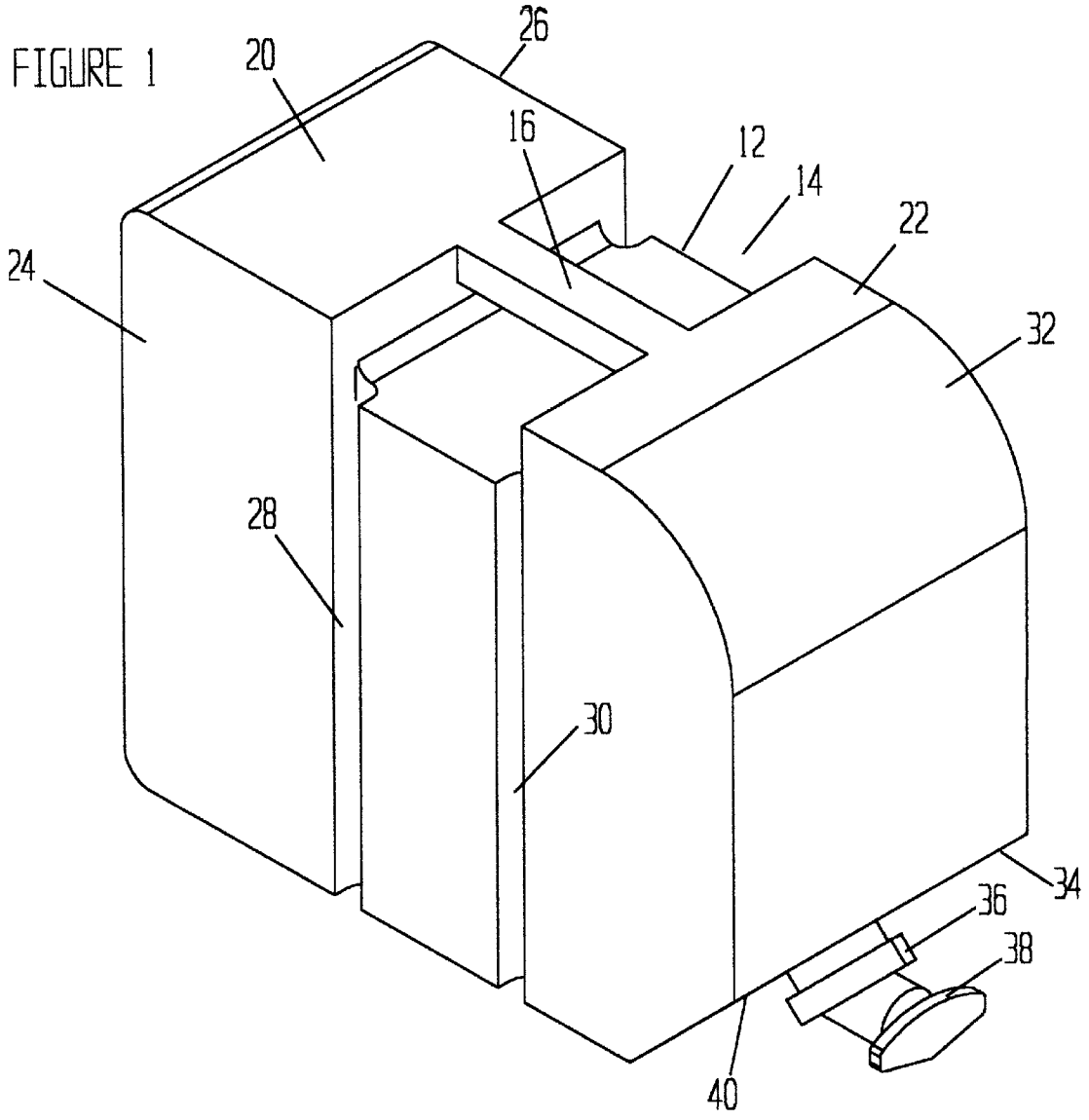
FIG. 1 is a perspective view of the ubiquitous two and one-half gallon water container.

FIG. 1 illustrates the ubiquitous, large volume (2.5 gallon) beverage container 10 commonly used for drinking water. The container 10 is a blow molded plastic container of relatively thin wall construction. The container 10 has a central portion 12 of reduced height thereby creating a niche 14 to accommodate an integrally formed handle 16 which extends between the opposed faces 18 on the distal portions 20 and 22 of the container 10. The major opposite and parallel walls 24 and 26 of the parallelpiped container 10 are reinforced with generally arcuate channels; a pair of channels 28 and 30 being provided on each major wall 24 and 26, traversing the walls and spaced apart by the length of the central portion 12. The forward upper edge 32 of the container 10 is formed with a large diameter radius and the lower forward edge 34 is beveled at a 45° angle. The beveled lower forward edge 34 of the container 10 provides accommodation for the dispensing nozzle 36 and valve 38 which are centrally mounted on the beveled wall 40.

The design of the beverage container 10 and the location of its dispensing valve 38 are primarily intended for positioning the beverage container 10 on a refrigerator shelf with the dispensing valve 38 overhanging the forward edge of the shelf thereby providing access and accommodation for positioning a beverage glass or container 10 beneath the dispensing spout. This design, however, ensures cumbersome use when the beverage container 10 is placed on a counter top, requiring that the user either lift the beverage container 10 to dispense contents into a glass or tumbler on the counter top or to place the container 10 adjacent the edge of the counter with the dispensing valve 38 hanging over the edge of the counter. This compromise is not acceptable because of the likelihood of spilling of contents onto the floor.

Figure 2:
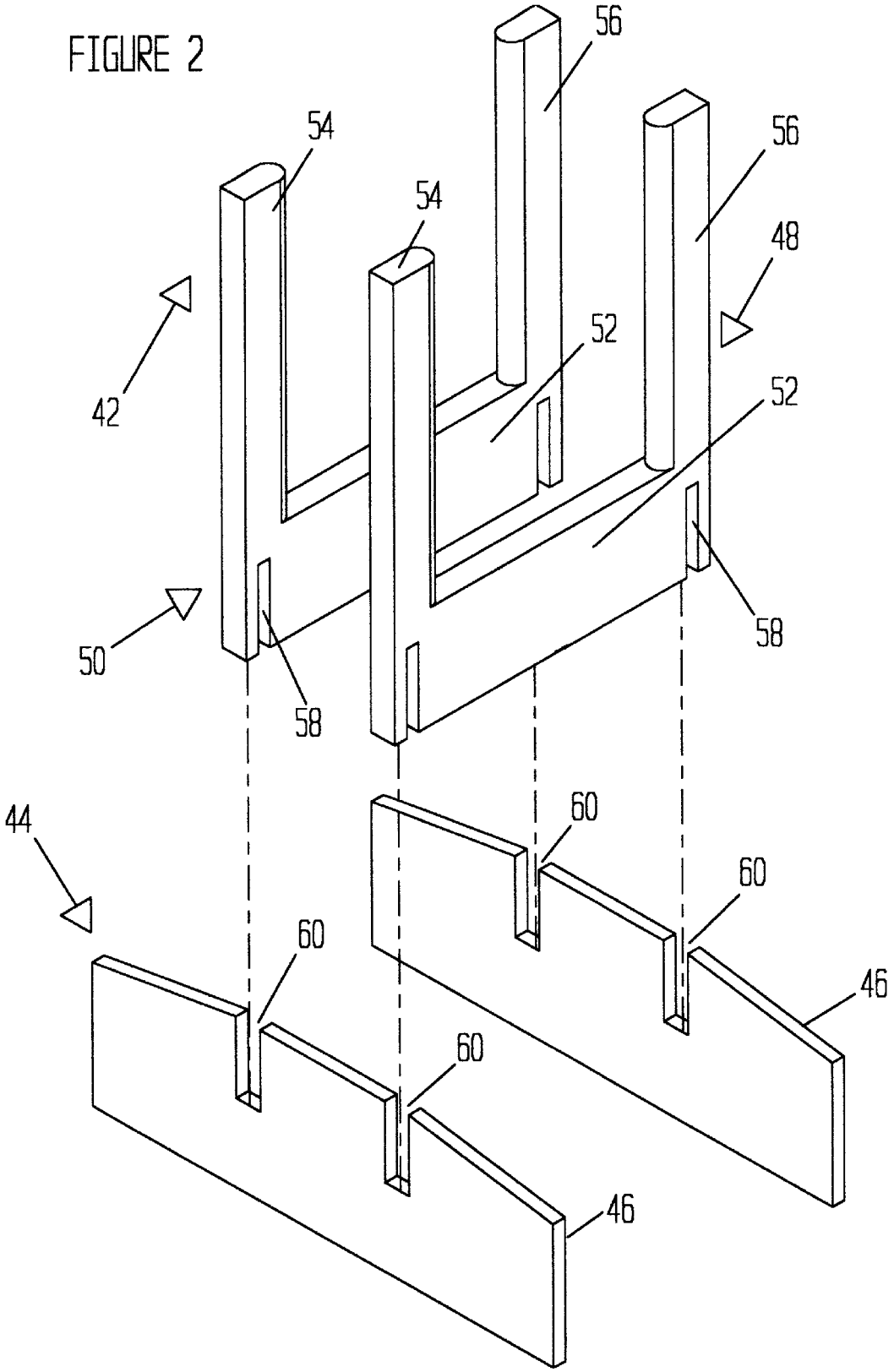
FIG. 2 is an exploded perspective view of the storage and dispensing rack of the invention.

Referring now to FIG. 2, there is illustrated a suitable storage rack 42 for the beverage container 10 shown in FIG. 1. As there illustrated, the storage rack 42 is of simple knock-down construction and comprises a base 44 formed of two parallel and longitudinal rails 46 which are spaced apart by a distance approximately equal to the width of the beverage container 10. The rails 46 are interlocked with a pair of cradle frames 48 and 50, each of which is formed with a cross rail 52 and distal stiles 54 and 56. The stiles 54 and 56 form support posts for the beverage container 10 and, to this end, are spaced apart by the distance between the traverse wall channels 28 and 30 of the beverage container 10. The cradle frames 48 and 50 and base rails 46 are assembled with interlocking half-lap joints comprising slots 58 in the lower edge of the cradle frames and mating slots 60 in the upper edges 62 of the longitudinal rails 46 thereby permitting assembly of the storage rack 42 in the configuration shown in FIG. 3.

Figure 4:
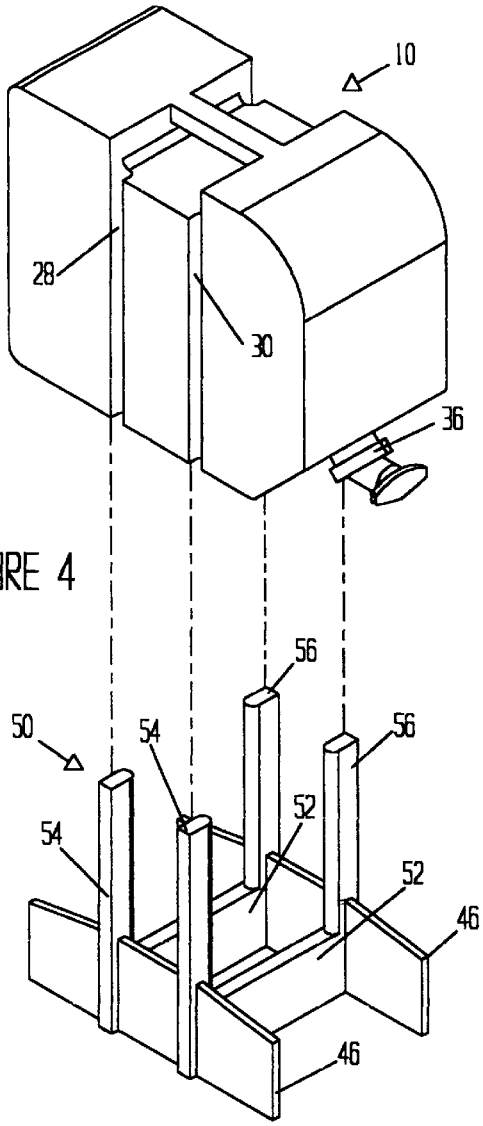
FIG. 4 is an exploded perspective view of the beverage container and the storage and dispensing rack of the invention.

As shown in FIG. 4, the cross rails 52 of the cradle frames 48 and 50 form cross ties in the assembled rack 42 and the stiles 54 and 56 of the cradle frames form four upright posts, each of which is received in a respective transverse wall channel 28 and 30 of the beverage container 10 thereby permitting the beverage container 10 to be firmly seated in the storage rack 42. In this assembly, the lower surface of the beverage container 10 rests on the upper edges of the cross rails 52.

Figure 5:
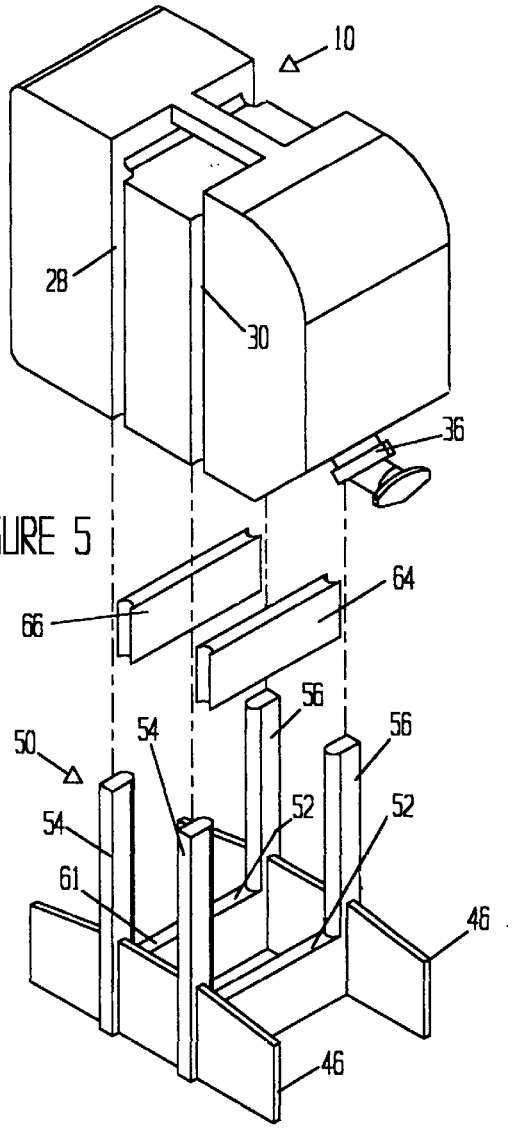
FIG. 5 is an exploded perspective view of the storage and dispensing rack of the invention illustrating removable dispensing rails useful in the dispensing configuration of the rack.

The rack 42 as thus illustrated is suitable for storage of the beverage container 10 and for supporting it in a compact configuration, suitable for location on a refrigerator shelf. When it is desired, however, to position the beverage container 10 on a counter top in a dispensing position, the rack 42 of the invention can be readily modified in the manner illustrated in FIG. 5. As shown in FIG. 5, a pair of dispensing rails 64 and 66 are positioned in the assembly on the cradle frames 48 and 50 of the rack 42, each dispensing rail 64 and 66 sliding between the upright stiles 54 and 56 of each cradle frame and resting on the upper edges 62 of the cross rails 52 of the cradle frames, thereby providing an elevated orientation for the beverage container 10.

Figure 3:
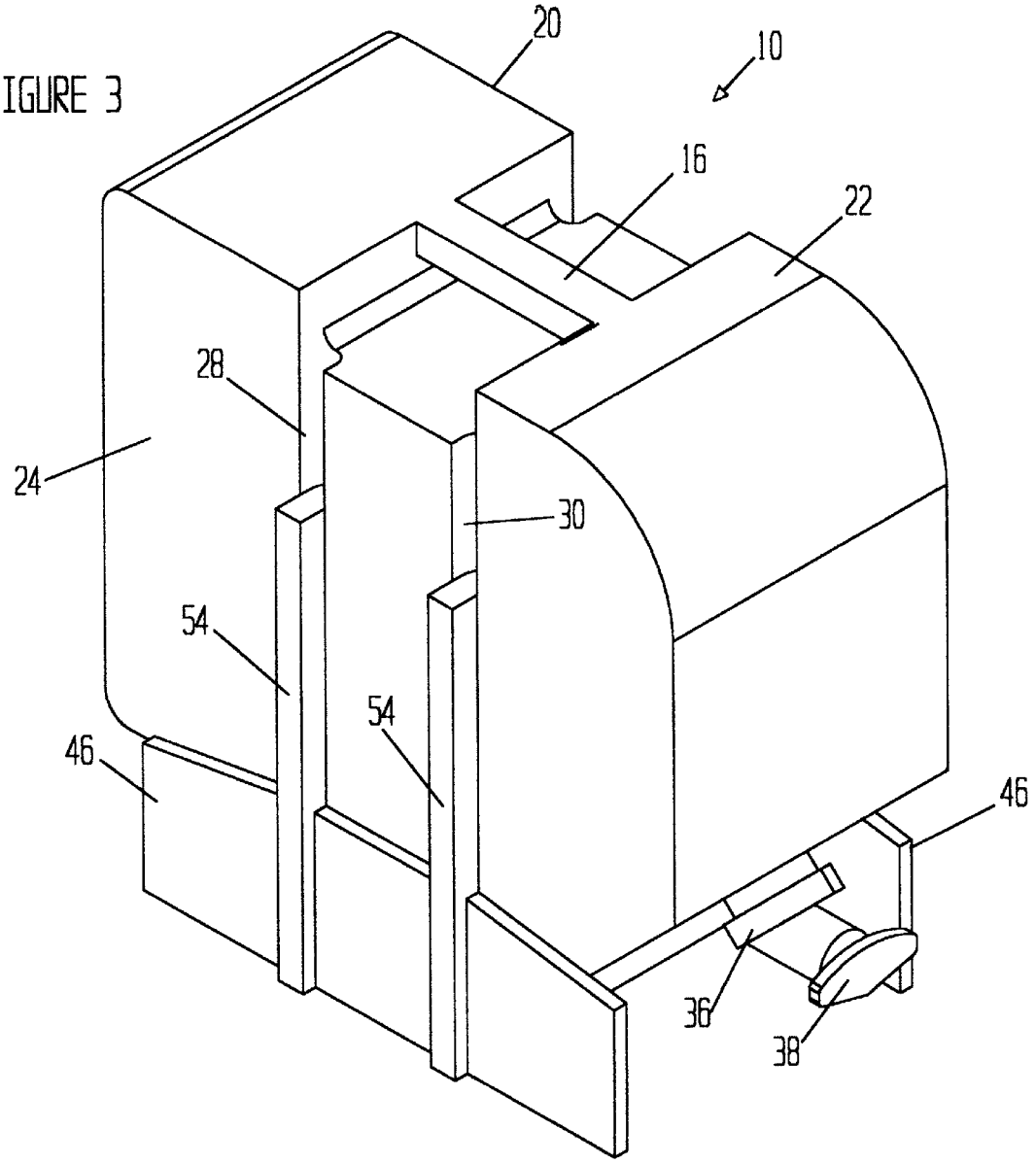
FIG. 3 is a perspective view of the beverage container resting in the storage and dispensing rack of the invention.
Figure 6:
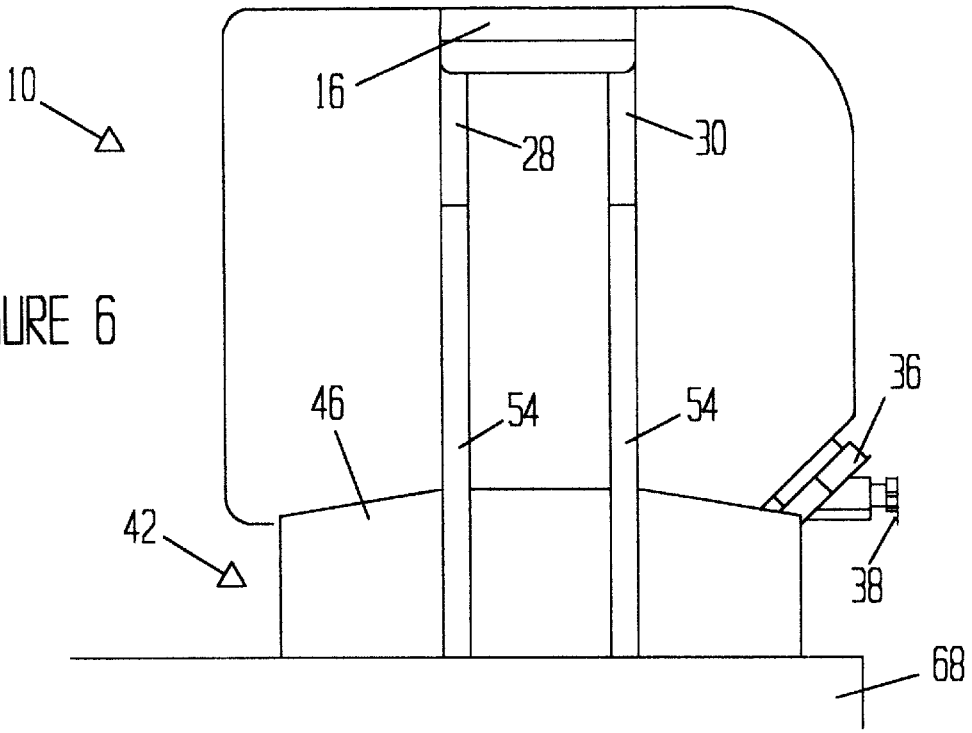
FIG. 6 is a side elevational view of the beverage container in the compact storage configuration of the rack of the invention.

Referring now to FIG. 6, the rack 42 of the invention is shown in its storage configuration described with reference to FIGS. 2–4. As there illustrated, the beverage container 10 is mounted in close proximity to the supporting surface 68 such as a refrigerator shelf.

Figure 7:
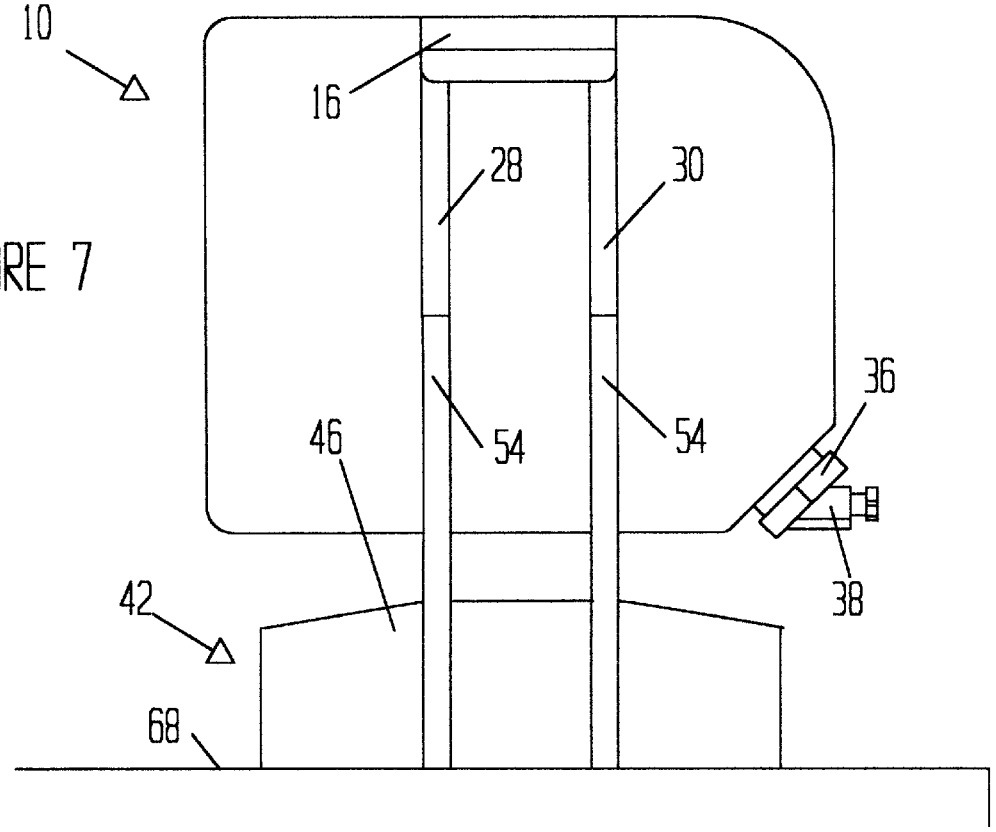
FIG. 7 is a side elevational view similar to FIG. 6 but with the dispensing rails of the rack supporting the beverage container in a dispensing position.

FIG. 7 illustrates the rack 42 of the invention in its dispensing position in assembly with the dispensing rails described and illustrated in FIG. 5. As there illustrated, the dispensing valve 38 is are located a sufficient distance above the supporting surface 68 to permit placement of a tumbler or other container beneath the valve for dispensing the contents of the beverage container 10.

Figure 8:
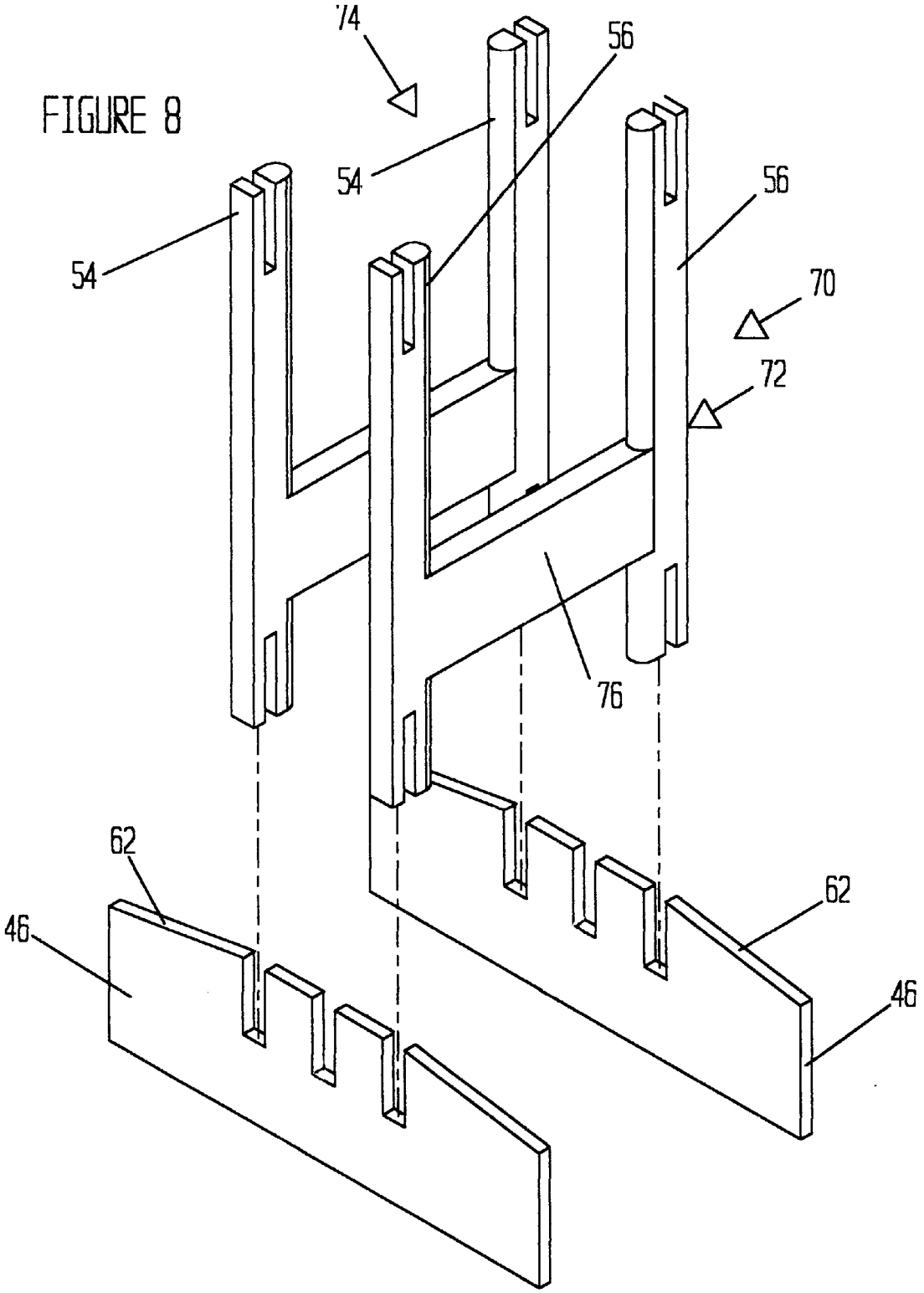
FIG. 8 is an exploded perspective view of an alternative embodiment of the storage and dispensing rack.
Figure 9:
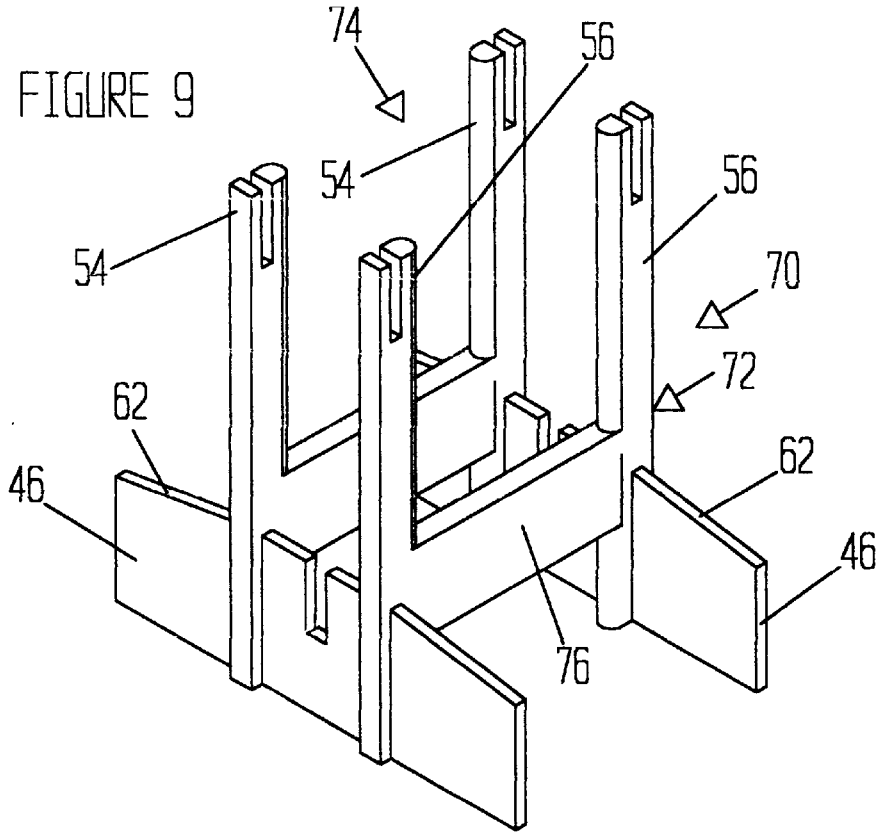
FIG. 9 is a perspective view of the alternative rack shown in FIG. 8 in its storage configuration.
Figure 10:
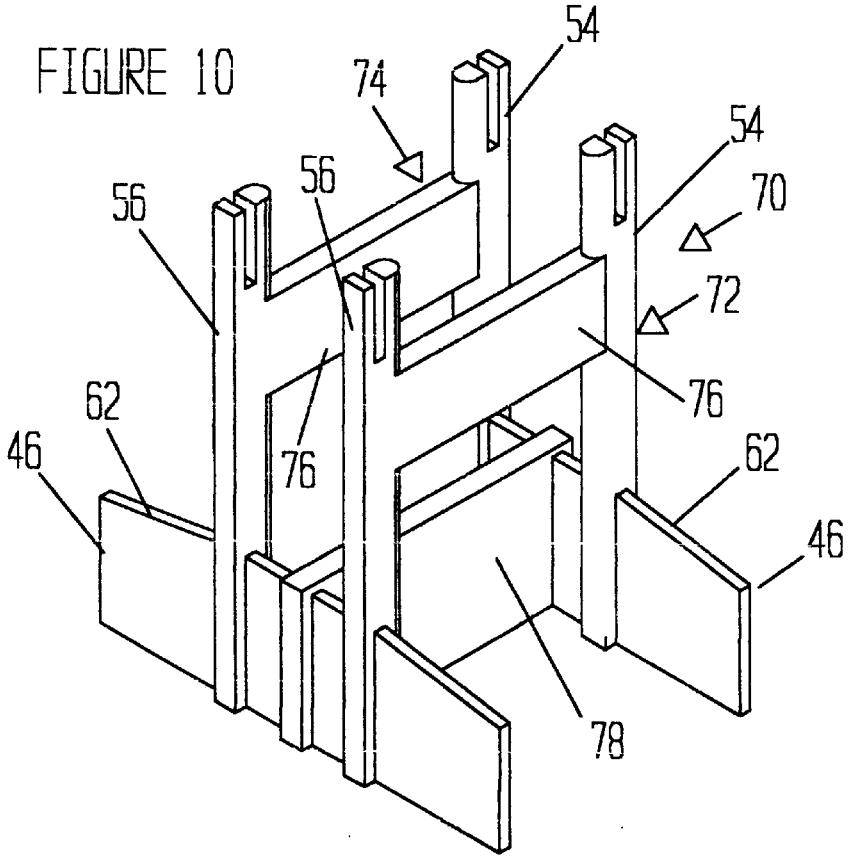
FIG. 10 is a perspective view of the assembled rack of FIG. 8 in its dispensing configuration.

Referring now to FIGS. 8–10, there is illustrated an alternative embodiment of the invention. As there illustrated, the rack 70 has cradle frames 72 and 74 which can be inverted between the storage and dispensing positions. For this purpose, each cradle frame 72 and 74 has a cross rail 76 that is located intermediate the lengths of the opposite distal stiles 54 and 56. The cross rail 76 is shown in FIGS. 8 and 9 to be located closely adjacent to the upper edges 62 of the longitudinal rails 46 of the storage rack 70 thereby locating the support for the beverage container 10 in the compact storage configuration of the rack such as illustrated in FIG. 6.

FIG. 10, however, illustrates the inverted orientation of the cradle frames 72 and 74 whereby the cross rails 76 of these frames are located at an elevated position substantially above the upper edges 62 of the longitudinal rails 46 of the rack 70 thereby supporting the beverage container 10 in an elevated position similar to that shown in FIG. 7.

Referring now to FIG. 10, there is illustrated an additional rail 78 which is useful with the rack embodiment shown in FIGS. 8–10. This rail 78 has half-lap slots which engage mating half-lap slots in the longitudinal rails of the base to position the rail 78 as shown in FIG. 10 between the cradle frames 72 and 74, whereby the cross rail 78 functions as a tie to prevent spreading of the longitudinal rails 46 of the rack 70. This element is optional and preferred when the rack 70 is configured in the dispensing position shown in FIG. 10.

The rack of the invention is of simple knock-down construction suitable for mass manufacture and distribution. The rack can be formed of various materials including wood and metals. Preferably, however, the rack is formed of inexpensive plastics such as thermoplastics, e.g., low or high density polyethylene, polypropylene, polyvinylchloride, etc.

The elements of the rack can be of solid, hollowform, or plastic foamed configuration. When formed of plastics the individual components can be formed by injection molding, blow molding or rotational molding, depending on the plastics employed and the economy of production. When formed of foam construction, the rack elements can be formed of the aforementioned thermoplastics in a foamed condition or can be of foamed thermosetting resins, e.g., polyurethane.

The knock-down construction of the rack also provides the user with the ability to dismantle and store the rack in a compact configuration when not is use.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. The combination of a storage and dispensing rack and a bottle which comprises:

a. a bottle characterized by a generally parallelpiped shape with at least two channels traversing opposite, parallel walls, spaced apart by an inter-spacing and located intermediate the major dimension of said walls of said bottle, with said bottle received in and supported by a storage and dispensing rack having:

a. a support base formed of a pair of longitudinal and parallel rails spaced apart a distance substantially equal to the width of said bottle; and b. a pair of H-shaped cradles with opposite and parallel stiles joined at a fixed spacing by a cross rail asymmetrically located at an intermediate height of said stiles and removably assembled to said longitudinal rails by a disengagable joint comprising;

(1) a pair of first joint elements located on each of said longitudinal rails at spaced apart positions corresponding to said inter-spacing of said channels of said bottle with said stiles being said stiles are located at positions to received in said channels of said bottle and said bottle resting on said cross rails; and (2) coacting second joint elements, one each at each end of said stiles whereby said cradles may be reversed, end-to-end, to locate said cross rails at a first, low position and a second, elevated position whereby said bottle can be supported on said cross rails at a low, storage position and an elevated, dispensing position.

2. The combination of the bottle and storage and dispensing rack of claim 1 wherein said cradles are removably assembled to said longitudinal rails.

3. The combination of the bottle and storage and dispensing rack of claim 1 wherein said disengagable joint is a half lap joint.

4. The combination of the bottle and storage and dispensing rack of claim 3 wherein said stiles have distal slots at their opposite ends to engage mating slots in the top edges of the longitudinal rails in half-lap joints.

5. The combination of the bottle and storage and dispensing rack of claim 1 wherein said cross rail is asymmetrically located along the heights of said stiles.

6. The combination of the bottle and storage and dispensing rack of claim 1 including a cross rail which functions as a tie member spanning between said longitudinal rails of said base.

7. The combination of the bottle and storage and dispensing rack of claim 6 wherein said cross rail is removably seated with distal disengagable joints to the middle of each of said longitudinal rails of said base, between said cradles.

* * * * *